US009180508B2

(12) United States Patent
Bishop

(10) Patent No.: US 9,180,508 B2
(45) Date of Patent: Nov. 10, 2015

(54) PRESS BRAKE

(75) Inventor: Jeffrey C. Bishop, Derby (GB)

(73) Assignee: ROLLS-ROYCE plc, London (GB)

( * ) Notice: Subject to any disclaimer, the term of this patent is extended or adjusted under 35 U.S.C. 154(b) by 831 days.

(21) Appl. No.: 13/113,437

(22) Filed: May 23, 2011

(65) Prior Publication Data

US 2011/0314890 A1 Dec. 29, 2011

(30) Foreign Application Priority Data

Jun. 23, 2010 (GB) ..... 1010528.6

(51) Int. Cl.

| | |
|---|---|
| ***B21D 5/02*** | (2006.01) |
| *B21D 37/14* | (2006.01) |
| *B30B 15/10* | (2006.01) |

(52) U.S. Cl.

CPC ..... *B21D 5/0209* (2013.01); *B21D 5/0236* (2013.01); *B21D 37/14* (2013.01); *B30B 15/10* (2013.01)

(58) Field of Classification Search

CPC ..... B21D 5/02; B21D 5/0272; B21D 5/0209; B21D 5/0236; B21D 5/0254; B21D 37/04; B21D 37/08; B21D 37/12; B21D 37/14; B30B 15/10; B30B 15/142

USPC ..... 72/389.1, 289.4, 389.5, 463, 465.1, 72/466, 470, 471, 476, 481.1, 481.2, 72/482.6, 482.91, 446–448; 100/219; 425/595

See application file for complete search history.

(56) References Cited

U.S. PATENT DOCUMENTS

| | | | | |
|---|---|---|---|---|
| 3,675,463 | A | 7/1972 | Munschauer, Jr. et al. | |
| 4,898,015 | A * | 2/1990 | Houston | 72/389.5 |
| 5,513,514 | A * | 5/1996 | Kawano | 72/482.91 |
| 6,003,360 | A * | 12/1999 | Runk et al. | 72/482.2 |
| 6,119,503 | A | 9/2000 | Peloquin et al. | |
| 6,499,330 | B1 * | 12/2002 | Pelech, Jr. | 72/389.4 |
| 8,099,992 | B2 * | 1/2012 | Rouweler et al. | 72/481.2 |
| 2002/0166360 | A1 * | 11/2002 | Runk et al. | 72/481.1 |
| 2006/0277970 | A1 * | 12/2006 | Pabich et al. | 72/481.1 |
| 2008/0098793 | A1 * | 5/2008 | Rogers et al. | 72/482.2 |
| 2015/0165506 | A1 * | 6/2015 | Jansen et al. | B21D 37/14 |

FOREIGN PATENT DOCUMENTS

| | | | |
|---|---|---|---|
| EP | 0 577 974 | A1 | 1/1994 |
| EP | 1 342 513 | A1 | 9/2003 |
| JP | U-51-005785 | | 1/1976 |
| WO | WO 00/59903 | A2 | 10/2000 |

OTHER PUBLICATIONS

European Search Report issued in European Patent Application No. 11 16 7137 dated Nov. 10, 2011.

British Search Report issued in British Application No. GB1010528.6 dated Jun. 30, 2010.

* cited by examiner

*Primary Examiner* — Alexander P Taousakis
*Assistant Examiner* — Pradeep C Battula
(74) *Attorney, Agent, or Firm* — Oliff PLC

(57) ABSTRACT

A press brake tool assembly mounting device (42) having a body (66) which mounts a lower press brake tool (46), with a recess in the body (66) receiving in a moving fit a location member (52) mounted to a lower beam (44). A locking arrangement (80) is provided for locking the body (66) relative to the location member (52) in a friction fit, to retain the lower press brake tool (46) in a required position.

11 Claims, 5 Drawing Sheets

PRESS BRAKE

This invention concerns improvements in or relating to press brakes, a press brake tool mounting device, a press brake assembly comprising a plurality of such devices, and a method of aligning a press brake assembly.

A press brake is a machine used for bending sheet metallic materials. It generally comprises two beams, one located above the other, with one being fixed and the other being moveable in a vertical plain relative to the other. Each beam mounts a respective elongate tool, with the beams being brought together to shape material held relative to the tools.

The top tool generally takes the form of a thin blade having a smoothly radiused bottom edge, whilst the bottom tool has a vertically symmetrical V notch on it's top surface, such that the centre line of the top blade and the centre line of the V notch should be precisely aligned along the whole length of the press brake beams.

With this arrangement a piece of sheet material placed on and resting across the lower tool will be subjected to symmetric bending forces when the tools are brought together and the top tool begins to penetrate the V. The degree to which the material is bent is dependent upon the depth of penetration of the top tool into the V. This can mean that bent angles of between say 5° and 180° can be achieved from a pair of tools, by controlling the depth of penetration of the top tool into the V.

As a result of the above features press brake bending is commonly used as it avoids the expense of particular tooling for individual bend requirements.

Also, the fact that press brake bending rarely if ever requires a top tool to fully penetrate a bottom V ('earth-out' through the entrapped material), means that material bending is achieved via the direct action of opposing forces lying along the three parallel lines of contact made between the top blade and the top of the V notch, with the corner of the induced bend being formed around the nose-radius of the top tool and between the sides of the V. This minimal area of contact between tooling and material (as opposed to 'form' bending which requires 100% contact on both sides of the material) has led to press brake bending being more colloquially know as 'air-bending'.

FIGS. 1 to 3 show a conventional press brake arrangement, with a moveable upper beam 10 and a stationary lower beam 12. Typically the lengths of the beams 10, 12 may be between 1 m and 3 m. A top tool 14 is mounted on the upper beam 10, and the tool 14 has a smoothly radiused lower end 16 in the form of a thin blade. The top tool 14 is held in position on the upper beam 10 by a hydraulically inflated hose 18 urging an upper part 20 of the top tool 14 against a face 22 of a receiving recess 24 provided in the upper beam 10.

A bottom tool 26 is mounted on the lower beam 12. A vertically symmetrical V shaped notch 28 is provided in the top of the bottom tool 26. The bottom tool 26 is mounted on the lower beam 12 by a projection 30 on the underside of the bottom tool 26 locating in a receiving recess 32 in the lower beam 12. A plurality of spaced grub screws 34 are provided engageable against the projection 30 to urge same against a face of the recess 32, to retain the bottom tool 26 on the lower beam 12.

FIGS. 1 to 3 sequentially show the upper beam 10 and hence top tool 14 being moved downwardly such that the lower end 16 of the top tool 14 engages against a sheet 36 of metal extending across the bottom tool 26. As the top tool 14 moves further downwards the sheet 36 of metal is bent until a bend 38 of say 90° is achieved as shown in FIG. 3. Obviously the amount of bending achieved can be varied dependent of the amount of penetration of the top tool 14 into the notch 28 of the bottom tool 26.

To provide accurate bending it is required that the top tool 14 and bottom tool 26 are totally parallel in plan view, and that the centre of the top tool 14 is aligned with the centre of the bottom tool 26. If the tools are not parallel a twisted bend will be produced. Press brakes are designed to enable the adjustment of the central alignment of the top and bottom tools 14, 26, but this method is somewhat compromised because it seeks to achieve the requirements of the centering and parallel alignment via a single simultaneous means of adjustment.

In practice it is rare for any press brake to give absolute bend consistency along the length of the tool, but it is common to be sufficiently consistent to be fit for purpose. This therefore means that in practice it is necessary to be aware of the potential variation of any bend produced by a press brake.

If the top and bottom tools 14, 26 are not centrally aligned, then the degree of bending on one side of the tools 14, 26 will be different to the degree of bending on the other side. Using non-aligned top and bottom tools 14, 26 also means that bending forces are induced in the tooling, which depending of the stiffness of the tooling and the security of its mounting, can have the effect of changing the relative position of the final bend with respect to the original position upon first engagement with a material to be bent.

Another feature of press brakes is to require that the distance between the top and bottom tools 14, 24 is consistent along the length thereof, as otherwise the degree of bend will vary along the length of the material.

According to a first aspect of the invention there is provided a press brake tool mounting device, the device including a locking assembly which mounts a press brake tool and comprises a recess, a location member located in part by the recess, the location member being securely engageable with a beam of a press brake, the location member having an engagement surface, the locking assembly including an engagement surface, and a locking arrangement which permits selective movement of the locking assembly engagement surface between an unlocked position clear of the location member engagement surface such that the locking assembly can be moved relative to the location member, and a locked position with the locking assembly engagement surface engaging against the location member engagement surface so as to hold the locking assembly and hence bottom tool in position relative to the location member, wherein the recess permits relative movement of the locking assembly relative to the location member when the locking arrangement is unlocked.

A recess may be provided in the locking assembly which locates part of the location member so as to permit relative movement of the locking assembly relative to the location member when the locking arrangement is unlocked.

The locking assembly may include a control member and a body, with the control member moveable relative to the body between locked and unlocked positions, with a locking spring extending between the control member and an engagement component, which component provides the locking assembly engagement surface, with the spring in a compressed condition in the locked position so as to urge the locking assembly engagement surface against the location member engagement surface.

The control member and locking spring may be configured such that when the control member is moved from an unlocked position to a locked position the spring is urged to an over centre position to retain the control member in the locked position.

The control member and body may be configured such that the control member is pushed inwards relative to the body to be moved into a locked position.

A further spring may be provided extending between the control member and the body, on an opposite side of the control member to the locking spring, which further spring may be substantially equivalent to the locking spring to substantially counterbalance same.

A release member may be pivotally mounted to the body and connected to the control member, such that pivotal movement of the release member moves the control member.

The release member may have a control part on an opposite side of the pivotal mounting to a connecting part with the control member such that pushing of the control part towards the body moves the control member to an unlocked position. The control part may be further spaced from the pivotal mounting than the connection part.

The engagement surfaces may have formations thereon to provide a high surface friction therebetween.

In a further embodiment alignable holes are provided in the location member and the locking assembly, with the holes in one of the location member or locking assembly having a significantly larger area than standard holes provided in the other of the location member or locking assembly, with fastening means engageable though the aligned holes and providing an engageable fit with the standard holes, and being held loosely on the location member and the locking assembly in the unlocked position, such that the one of the location member and the locking assembly can be moved relative to the other by virtue of the fastening means being a loose fit through the larger holes, and in the locked condition the fastening means clamp the location member and the locking assembly together.

The fastening means may comprise an elongate threaded member with a head which engages on one side of the location member and/or the locking assembly, and a threaded member engageable on the elongate threaded member so as to be engageable with an opposite side of the location member and/or locking assembly.

The invention further provides a press brake assembly, the assembly including a plurality of press brake tool mounting devices according to any of the preceding eleven paragraphs, spaced along the length of the assembly.

The invention still further provides a method of aligning a press brake assembly according to the above paragraph, the method including with the press brake tool mounting devices in an unlocked position, bringing upper and lower tools fully together to provide a correct alignment, and locking the press brake tool mounting devices whilst the tools are fully together.

Embodiments of the present invention will now be described by way of example only and with reference to the accompanying drawings, in which:—

Figure 1:
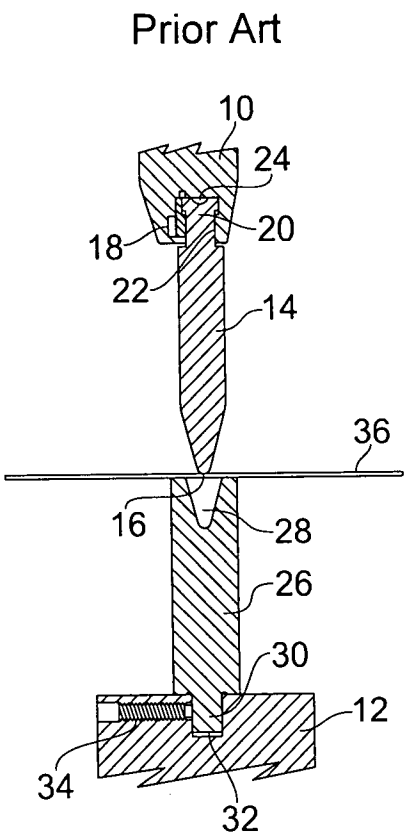
FIGS. 1 to 3 are diagrammatic cross-sectional end views of a conventional press brake assembly sequentially in use.
Figure 2:
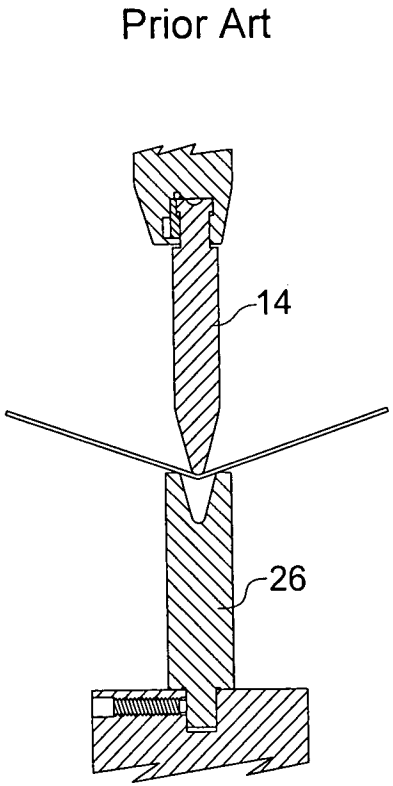
Figure 3:
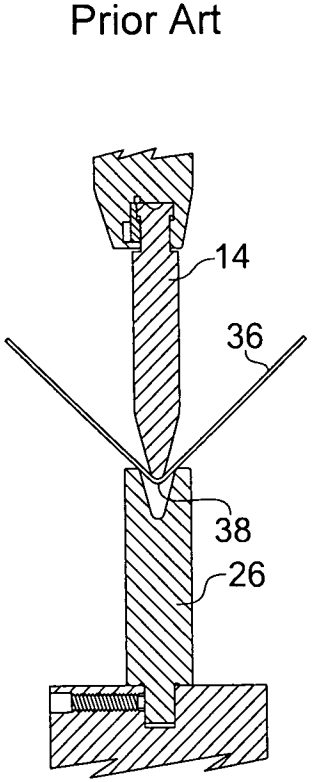

FIGS. 4 to 8 show a press brake tool assembly 40 according to the invention. The assembly 40 is similar to the arrangement shown in FIGS. 1 to 3, aside from the fact that three press brake tool mounting devices 42 are provided equispaced along the lower beam 44 for mounting the bottom tool 46 thereto. The upper beam 48 and top tool 50 are similar to those as described in FIGS. 1 to 3.

Each assembly 40 includes a location fork 52 which securely locates in the receiving recess 54 in the lower beam 44. Whilst a locking grub screw 56 is shown, this should not be required. The location fork 52 is made from laminated sheet metal cut to shape using a laser cutting process.

The location fork 52 in cross-section has a generally T shape configuration, with the stem of the T having a pair of elements 58 with a gap in between to provide secure location in the receiving recess 54. The left hand top limb 60 of the T is a little longer than the right 62, and an engagement surface 64 is provided on the left hand limb 60 of the T. The engagement surface 64 is a little recessed, and has a ribbed surface to provide a high friction engagement.

The devices 42 also include a body 66 with an upwardly facing passage 68 which securely receives the lower end of the bottom tool 46. Beneath the passage 68 and spaced a little way therefrom, is a generally T shaped cross-section recess 70 which receives an upper part of the locating fork 52 so as to permit lateral movement thereof, as the recess 70 extends laterally to a greater extent that the length of the location fork top limbs 60, 62.

Provided within the body 66 is also located an engagement component 72 which has a downwardly facing engagement surface 74 which has ribbed formations thereon to increase friction, and is of a size to fit within the recessed engagement surface 64 on the location fork 52. An upper part of the engagement component 72 provides a recess 76 which mounts one end of a locking spring 78.

A control member 80 is provided which is slideably moveable in and out of the body 66 in a horizontal alignment. The control member 80 includes an elongate part 82 which includes opposite upwardly and downwardly facing recesses 84, the downwardly facing one of which locates the other end of the locking spring 78. The upwardly facing recess 14 receives one end of a further spring 86, which spring 86 is substantially identical to the locking spring 78. The other end of the further spring 86 is mounted to a downwardly facing recess 88 in the body 66 directly above the engagement component recess 76.

The outer end of the elongate member 80 extends into a control part 90. A release member 92 is provided in the form of an elongate part 94 which is pivotally mounted at 96 to the body 66 generally adjacent to the elongate member 76. The elongate part 94 has a recessed end 98 which engages with a transverse projection 100 on the elongate member 82. The other end of the elongate part 94 extends for a significantly greater distance from the pivotal mounting 96 to the body, and connects to a control part 102 that extends outside of the body 66.

Figure 6:
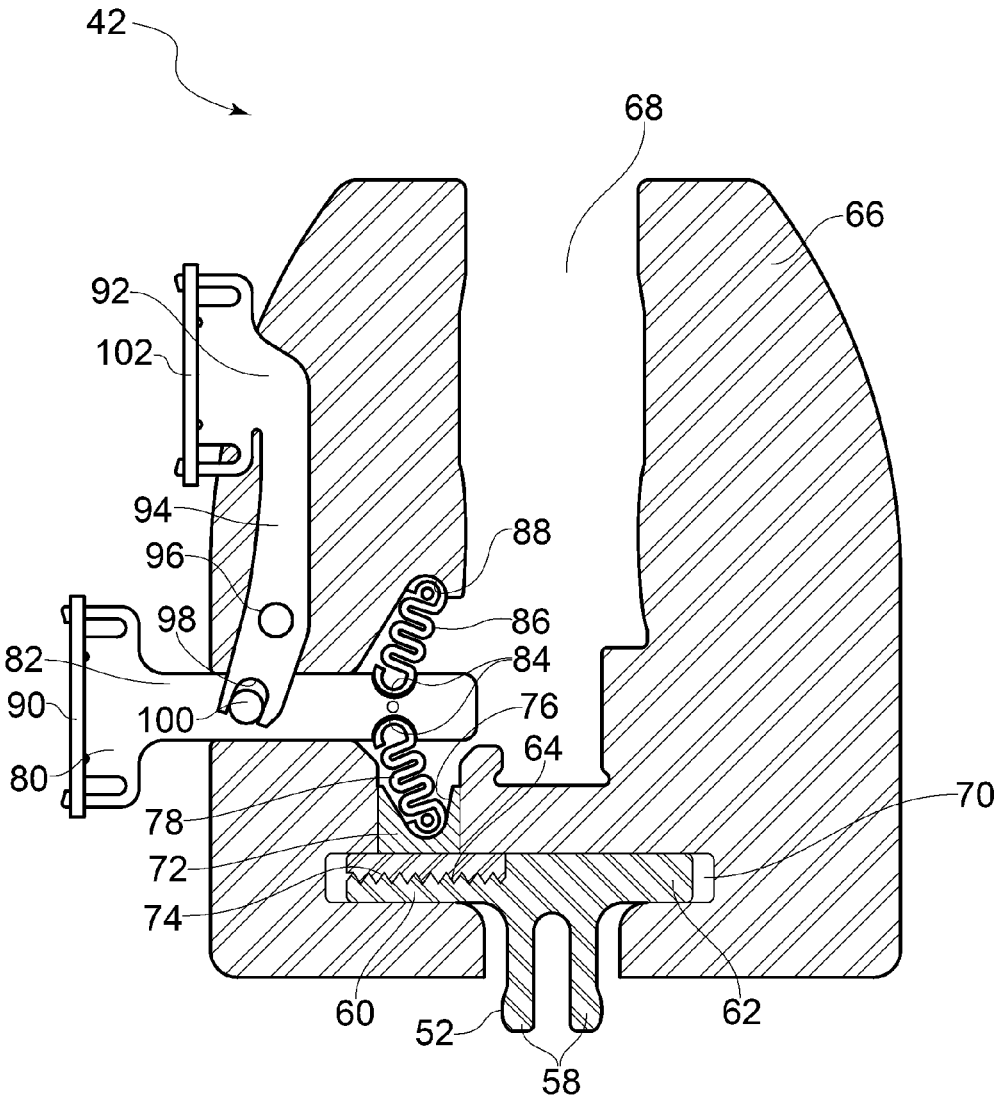
FIG. 6 is a diagrammatic cross-sectional end view of a press brake tool mounting device as shown in FIG. 4, in an unlocked position.
Figure 7:
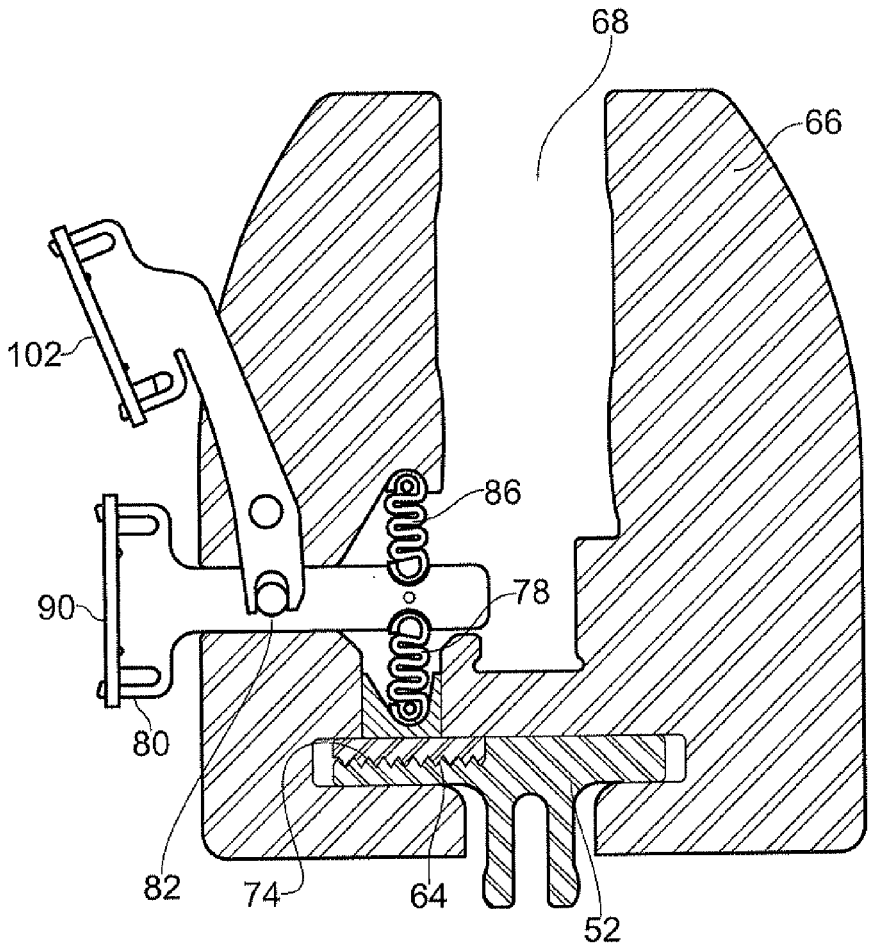
FIG. 7 is a similar view to FIG. 6 but with the mounting device in a locked position.

The devices 42 can be moved between an unlocked position as shown in FIG. 6, and a locked position as shown in FIG. 7. In the unlocked position shown in FIG. 6 the control member 80 extends outwardly from the body 66, with the transverse projection 100 outwardly of the pivotal mounting 96 of the release member 92. The springs 78 and 86 are in a relaxed condition, such that the engagement component 72 is not urged against the location fork 52. Accordingly the body 66 and hence lower tool 46 can be moved relative to the location fork 52.

To move a device 42 to the locked condition, the control part 90 of the control member 82 is pushed inwardly such that the transverse projection 100 moves to just beyond beneath the pivotal mounting 96 of the release member 92, and the springs 78, 86 move just beyond an over centre position but remain in a compressed condition. This condition of the springs 78, 86 urges the engagement component 72 and thus the engagement surface 74 thereon against the engagement surface 64 on the location fork 52, thereby locking the body 66 and hence bottom tool 46 in position relative to the location fork 52.

To move a device 42 to an unlocked condition, the control part 102 of the release member 92 is pushed towards the body 66, urging the control member 80 outwardly past the centre position of the springs 78, 86 to the position shown in FIG. 6, where the engagement component 72 is not urged towards the engagement surface 64 on the location fork 52.

Figure 5:
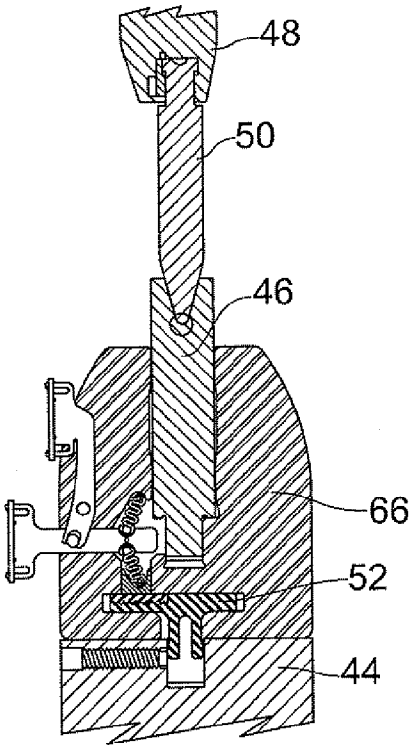
FIG. 5 is a similar view to FIG. 4 but with the top and bottom tools having been brought together.
Figure 4:
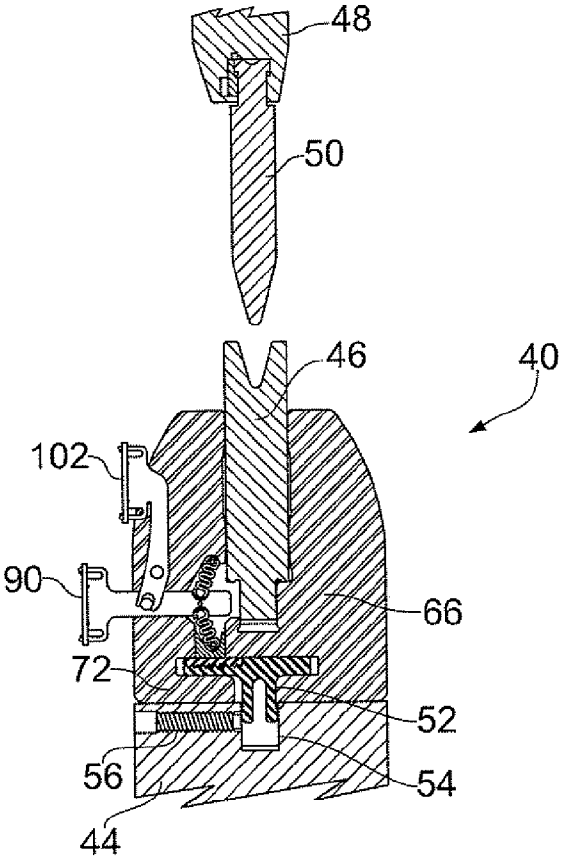
FIG. 4 is a diagrammatic cross-sectional end view of a first press brake assembly according to the invention in an unlocked condition.

To correctly align an assembly 40, all of the devices 42 thereon can be moved to an unlocked condition, as shown for instance in FIG. 4. The bodies 66 will then be free to move relative to the respective location forks 52. The upper beam 48 and hence top tool 50 are moved downwardly until the top tool 50 fully locates in the bottom tool 46 as shown in FIG. 5. As can be seen this will automatically move the body 66, and hence bottom tool 46 to a correct alignment, both centrally and with the tools 46, 50 in a parallel alignment. The devices 42 can then be locked in position and the top tool 50 raised back up. The press brake is then ready for use with accurate centre and parallel alignment for accurate consistent bending. The assembly 40 can be periodically realigned as outlined above following use.

Figure 8:
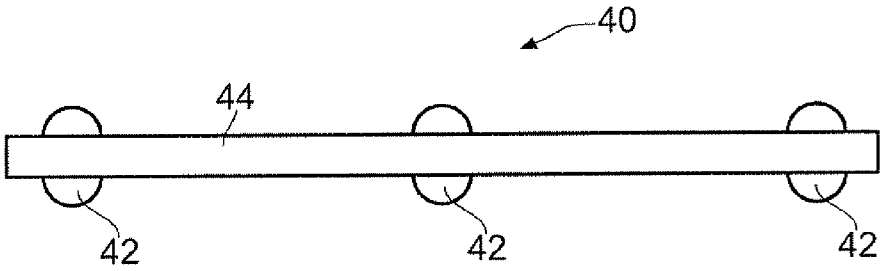
FIG. 8 is a diagrammatic plan view of the press brake assembly of FIG. 4.

FIG. 8 illustrates the assembly 40 with three devices 42, but the central device may in fact be a dummy device without the requirement for locking and unlocking. A different number of devices may be provided dependent on the length of an assembly and any other conditions or requirements. This could depend on the physical robustness of the bottom tool along with consideration of the magnitude of the bending loads likely to be incurred.

Figure 9:
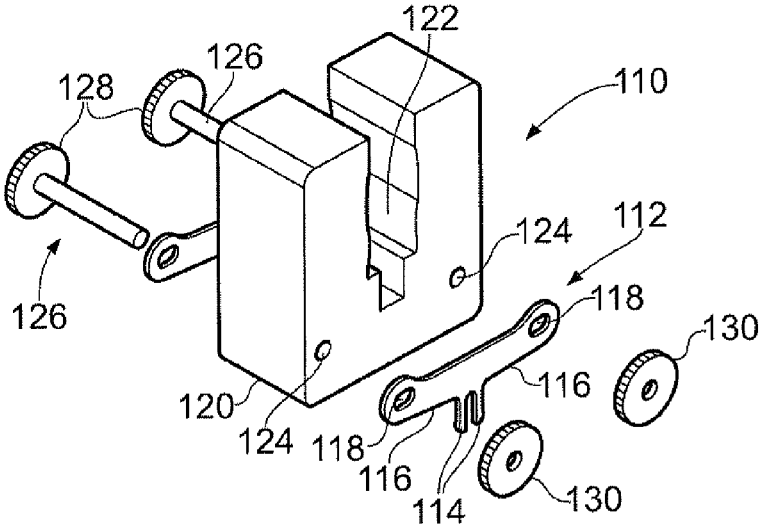
FIG. 9 is an exploded view of a second press brake tool mounting device according to the invention.
Figure 10:
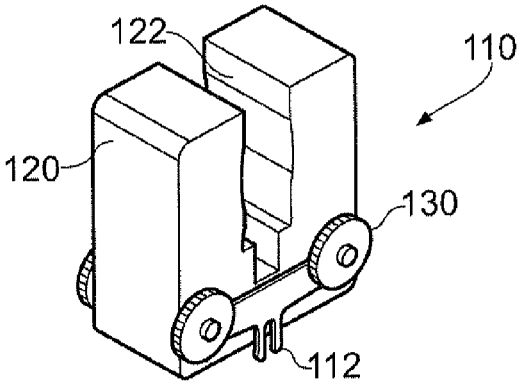
FIG. 10 is a perspective view of the device of FIG. 9 in a locked condition.

FIGS. 9 and 10 show a further press brake tool mounting device 110 according to the invention. In this instance a pair of location forks 112 are provided. The forks 112 again comprise spaced fingers 114 for location in a receiving recess of a lower beam. Arms 116 extend up from either side of the fingers 114 and holes 118 are provided through each of the arms 116, towards free ends thereof.

A profiled block 120 is provided, which could be made by milling or profiling, which has a recess 122 to receive the lower end of a bottom tool. A pair of holes 124 are provided through the block 120 towards bottom corners thereof. The block holes 124 are smaller than the fork holes 118.

A pair of clamping bolts 126 are provided with enlarged heads 128, and with clamping knobs 130 mountable on the bolts 126. The bolts 126 can extend through the holes 118 and 124 when aligned, with the clamping knobs 130 loosely fitted on the bolts 126. In this condition the device 110 is unlocked, and by virtue of the greater size holes 118 in the forks 112, the position of the block 120 relative to the forks 112 can be adjusted. Once a required position is found, for instance by the top tool engaging in the bottom tool, the blocks 120 can be locked in position by tightening the clamping knobs 130 on the bolts 126.

There is thus provided a further assembly permitting accurate adjustment and retention of the bottom tools on a press brake. If required it may be that only one location fork would be required.

Various other modifications may be made without departing from the scope of the invention. For instance a further different locking arrangement could be used, and with a different release arrangement. For instance it may be that a separate release member would not be required.

The invention claimed is:

1. A press brake tool mounting device comprising a locking assembly that mounts a press brake tool and comprises:

a recess having a T-shaped cross section, a location member having a T-shaped cross section and being located in part by the recess, and a locking assembly engagement surface, wherein:

the location member has a stem and an upper part, the upper part comprising a left hand top limb and a right hand top limb, the location member is configured to engage with a beam of a press brake and comprises a location member engagement surface provided on the left hand top limb of the location member, the locking assembly comprises a locking arrangement configured to permit selective movement of the locking assembly engagement surface between an unlocked position and a locked position, in the unlocked position, the locking assembly engagement surface is configured to not press against the location member engagement surface such that the locking assembly can be moved relative to the location member, in the locked position, the locking assembly engagement surface is configured to press against the location member engagement surface to hold the locking assembly and a bottom tool in a position relative to the location member, and the recess is configured to receive the upper part of the location member so as to permit lateral movement of the locking assembly relative to the location member when the locking arrangement is in the unlocked position.

2. The mounting device according to claim 1, wherein:

the locking assembly further comprises a control member, a body, a locking spring, and an engagement component, the control member is configured to be moveable relative to the body between the locked position and the unlocked position, the locking spring extends between a side of the control member and the engagement component, the engagement component comprises the locking assembly engagement surface, and when the locking arrangement is in the locked position, the locking spring is configured to be in a compressed condition to press the locking assembly engagement surface against the location member engagement surface.

3. The mounting device according to claim 2, wherein when the control member is moved from an unlocked position to a locked position, the locking spring is configured to move to an over centre position to retain the control member in the locked position.

4. The mounting device according to claim 2, wherein when the locking arrangement shifts from the unlocked position to the locked position, the control member is configured to move in an inward direction towards the body.

5. The mounting device according to claim 2, wherein the locking assembly further comprises a spring that extends between the body and a side of the control member that opposes the side of the control member from which the locking spring extends.

6. The mounting device according to claim 5, wherein the locking spring and the spring are substantially equivalent.

7. The mounting device according to claim 2, wherein the locking assembly further comprises a release member that is pivotally mounted to the body and connected to the control member, the release member being configured to pivotally move the control member.

8. The mounting device according to claim 7, wherein:

the release member comprises a control part on an opposite side of the pivotal mounting to a connecting part with the control member, and the control part is configured to be pushed towards the body to move the locking assembly to an unlocked position.

9. The mounting device according to claim 8, wherein the control part is closer to the connecting part than to the pivotal mounting.

10. The mounting device according to claim 1, wherein the locking assembly engagement surface and the location member engagement surface comprise formations configured to increase surface friction between the locking assembly engagement surface and the location member engagement surface.

11. A press brake assembly comprising a plurality of press brake tool mounting devices according to claim 1, spaced along said beam of said press brake.

* * * * *